US005609041A

United States Patent [19]

Rathbone et al.

[11] Patent Number: 5,609,041

[45] Date of Patent: Mar. 11, 1997

[54] AIR SEPARATION

[75] Inventors: Thomas Rathbone; Brian A. Keenan, both of Surrey, United Kingdom

[73] Assignee: The BOC Group plc, Windlesham, England

[21] Appl. No.: 572,230

[22] Filed: Dec. 13, 1995

[30] Foreign Application Priority Data

Dec. 16, 1994 [GB] United Kingdom ..... 9425484

[51] Int. Cl.[6] ..... F25J 3/00

[52] U.S. Cl. ..... 62/646; 62/654

[58] Field of Search ..... 62/646, 654

[56] References Cited

U.S. PATENT DOCUMENTS

| | | | |
|---|---|---|---|
| 5,379,598 | 1/1995 | Mostello | 62/654 |
| 5,402,646 | 4/1995 | Rathbone | 62/654 |
| 5,440,884 | 8/1995 | Bonaquist et al. | 62/654 |
| 5,454,227 | 10/1995 | Straub et al. | 62/654 |
| 5,467,602 | 11/1995 | Paolino et al. | 62/654 |

*Primary Examiner*—Ronald C. Capossela
*Attorney, Agent, or Firm*—David M. Rosenblum; Larry R. Cassett

[57] ABSTRACT

A first flow of air is compressed in a first air compressor associated with a gas turbine and is purified in an adsorptive purification unit which separates water vapour and carbon dioxide from the air. The purified first flow of air is further compressed to a pressure at least 5 bar higher than that at which it is purified in a second air compressor whose outlet pressure is independent of fluctuations in the power output of the gas turbine, is cooled in a main heat exchanger, is passed through an expansion valve, and is introduced into a higher pressure rectification column. A second flow of air is compressed in a third air compressor which is independent of the gas turbine. The compressed second flow of air is purified in an adsorptive purification unit by the separation of water vapour and carbon dioxide therefrom. The purified second flow of air is cooled in the main heat exchanger and is introduced into the higher pressure rectification column. The air flows are rectified in the higher pressure rectification column and an associated lower pressure rectification column operating at pressures above 2 bar. A nitrogen product is withdrawn from the top of the lower pressure rectification column and a liquid oxygen product from the bottom thereof. The liquid oxygen is revised in pressure to at least 25 bar by a pump and is warmed to ambient temperature in the main heat exchanger.

20 Claims, 2 Drawing Sheets

AIR SEPARATION

BACKGROUND OF THE INVENTION

This invention relates to a method and apparatus for separating air. It is particularly but not exclusively concerned with separating from air an oxygen product for use in the generation at high pressure of a fuel gas which is in turn fed to the combustion chamber of a power generating gas turbine.

The operation of a gas turbine in order to generate power is well known. A gas turbine comprises a compressor, a combustion chamber and an expander. The compressor and expander are both of a rotary kind and their rotors are typically mounted on the same shaft as one another. Air is fed to the compressor and is thereby raised in pressure typically to about 15 bars. The compressed air passes to the combustion chamber in which it supports the combustion of a pressurised fluid fuel. The resulting gaseous combustion products flow into the expander and are expanded therein to a pressure of about 1 bar. The work of expansion not only provides the power necessary to drive the compressor but is also used to drive an alternator forming part of electrical power generation plant.

It is known from, for example, U.S. Pat. No. 4,224,045 and U.S. Pat. No. 4,557,735 to take a bleed of the compressed air and separate it by rectification into oxygen and nitrogen products. At least a part of the nitrogen product may be introduced into the turbine to compensate for the reduced rate of generation of combustion products that is the consequence of taking the air bleed. (Introduction of nitrogen into the combustion products also helps to reduce formation of oxides of nitrogen.) The operational output of the gas turbine depends on the flow of combustion products and nitrogen to the expander. A gas turbine is normally required to operate under a range of different conditions so as to be able to meet a range of varying demands for electrical power. In particular, demand for power during the night is usually less than in the day. Normally, the gas turbine is designed for operation at maximum output and employs an axial air compressor.

Although it is possible to turn down to some extent an axial compressor, that it is to reduce the flow rate of compressed air out of the turbine, the reduction is accompanied by a rapid drop in the outlet pressure of the air. Accordingly, turn down of the compressor to meet variations in the demand for electrical power leads to a marked reduction in the pressure at which the air is separated. Such a variable air feed pressure to the rectification column or columns of an air separation plant present major operational and control problems. It is therefore desirable to maintain a constant air feed pressure. Such a constant air feed pressure can be achieved by maintaining at steady state the operation of the air compressor forming part of the gas turbine, and appropriately increasing the rate at which air is bled to the air separation plant. However, the result of increasing the rate at which air is fed to the air separation plant is to increase the rate of oxygen production. During periods in which the electrical power demand is at a reduced level, the demand of the gas turbine for fuel gas (and hence the demand for oxygen in the gasification plant) is also reduced. Thus, the rate of production of oxygen is increased in a period when the demand for it actually falls. Accordingly, operating the air compressor at a constant pressure while varying the rate at which air is bled from it to an air separation plant will rarely be a satisfactory solution to the problem of integrating an air separation plant, a gas turbine and a gasification plant.

It is of course possible to solve these or analogous problems by having an entirely independent feed to the air separation plant. This measure however sacrifices the whole of the cost benefit that can be gained if the air separation plant is supplied from the air compressor of the gas turbine.

DE-A-3 908 505 discloses with reference to its FIG. 2 a process for separating air in which one part of the air feed is supplied from the gas turbine and another part from an independent compressor. A portion of that part of the air that is supplied from the gas turbine is condensed and is passed through a pressure reduction valve into the pressure stage of a double column comprising a first stage which operates at elevated pressure and a second stage which operates at approximately atmospheric pressure. The independent compressor also supplies air but in vapour state to the pressure column. The independent compressor thus has an outlet pressure a little above that of the pressure column. The liquid air feed to the pressure column is condensed by heat exchange with a pressurised stream of liquid oxygen withdrawn from the lower pressure column by means of a pump. The oxygen is thus vaporised. A disadvantage of this arrangement is that if nitrogen is required to be introduced from the low pressure column into the expander of the gas turbine, it is necessary to raise its pressure from about 1 bar to the operating pressure at the inlet to the expander (normally in the order of 15 bar). It is therefore not possible to obtain the substantial power savings that are achieved in for example the processes of U.S. Pat. No. 4,224,045 and U.S. Pat. No. 4,557,735 by operating the lower pressure column at a pressure well in excess of atmospheric pressure.

Indeed, if nitrogen is required to be fed to the expander of the gas turbine from the lower pressure column, DE-A-3 908 505 discloses in FIG. 3 a process for this purpose. In this process, the entire air flow to the air separation plant is taken from the air compressor of the gas turbine and the high pressure column is operated at substantially the outlet pressure of the gas turbine. In addition, an oxygen product is taken in gaseous state from the low pressure column and therefore requires compression at an oxygen outlet of the plant. Thus, this air separation plant is subject to the control problems mentioned hereinabove and also requires a gaseous oxygen compressor.

It is an aim of the present invention to provide a method and plant for separating air and producing a high pressure oxygen product which are relatively easy to control, which are able to provide an elevated pressure nitrogen stream from the lower pressure column, but which take a part of their feed from the air compressor associated with a gas turbine.

SUMMARY OF THE INVENTION

According to the present invention there is provided a method of separating air comprising:

a) taking a first flow of air from a first air compressor associated with a gas turbine;

b) purifying said first flow of air by separating water vapour and carbon dioxide therefrom;

c) further compressing at least part of the first air flow in a second air compressor;

d) heat exchanging at least part of the further compressed and purified first air flow with a stream of pressurised oxygen taken from a lower pressure rectification column in liquid state;

e) reducing the pressure of at least part of the heat exchanged first air flow and introducing it into a higher pressure rectification column;

f) compressing a second flow of air in a third air compressor which is independent of said gas turbine;

g) purifying said second flow of air by separating water vapour and carbon dioxide therefrom, cooling the second flow of air, and introducing the cooled second flow of air into the higher pressure rectification column;

h) rectifying the air flows in the higher and lower pressure rectification columns; and i) withdrawing a gaseous nitrogen stream from the lower pressure rectification column;

characterised in that:

i) the second air compressor has an outlet pressure independent of fluctuations in the power output of the gas turbine;

ii) the purification of the first air flow is performed at a pressure at least 5 bar less than that at which the said part of the first air flow leaves the second compressor;

iii) the lower pressure rectification column is operated at pressures in excess of 2 bar;

iv) the liquid oxygen is pressurised to a pressure of at least 25 bar.

The invention also provides plant for separating air comprising:

a) a first air compressor associated with a gas turbine;

b) apparatus for purifying said first flow of air by separating water vapour and carbon dioxide therefrom;

c) a second air compressor for further compressing at least part of said purified first air flow;

d) a heat exchanger for reducing the temperature of the first air flow in countercurrent heat exchange with a stream of pressurised oxygen;

e) an arrangement of a higher pressure rectification column and a lower pressure rectification column, the higher pressure column having an inlet for at least part of the cooled first air flow;

f) a third air compressor for compressing a second flow of air which is independent of said gas turbine;

g) apparatus for purifying said second flow of air by separating water vapour and carbon dioxide therefrom;

h) a heat exchanger for cooling the purified second flow of air having an outlet for cooled air in communication with the higher pressure rectification column; and i) a pump for withdrawing said stream of pressurised oxygen from the lower pressure rectification column; and j) an outlet from the lower pressure rectification column for a gaseous nitrogen stream;

characterised in that:

i) the second air compressor has means for adjusting its operation so as to set its outlet pressure independently of fluctuations in the power output of the gas turbine;

ii) the apparatus for purifying the first flow of air is in a position upstream of the second air compressor or has an inlet in communication with an outlet of one stage of the second air compressor and an outlet in communication with an inlet of another stage thereof;

iii) the lower pressure rectification column is operable at pressures in excess of 2 bar;

iv) the said pump is operable to raise the pressure of the oxygen to at least 25 bar.

The method and plant according to the present invention are particularly suitable for use in supplying an elevated pressure gaseous oxygen stream at about 40 bar to a coal gasification plant (which is employed to generate a fuel gas that is burned in the combustion chamber of the gas turbine) in a manner which is simple to control and which is able to cope with fluctuations in the power output of the gas turbine (and hence in the pressure of the air that flows to the combustion chamber of the gas turbine). The method and plant according to the invention are capable of being operated without recourse to an oxygen gas compressor on the warm end side of the heat exchanger in which the pressurised oxygen stream is heat exchanged with the second air flow. Such gaseous oxygen compressors need to be maintained with the utmost care in view of the potential explosion hazard they pose, and the avoidance of their use is in practice a considerable advantage.

The second air compressor is preferably an integrally-geared centrifugal compressor having a plurality of impellers. In such a compressor, each impeller typically has its own housing and has a set of guide vanes associated with its upstream side and a set of diffuser vanes associated with its downstream side. By arranging for some or all of the sets of guide vanes and/or diffuser vanes to be adjustable, the second air compressor is able to supply air at a substantially constant outlet pressure in the normal range of fluctuations of gas turbine power output that are encountered. Further, the ratio of the outlet to inlet pressure of the second air compressor is preferably relatively high, i.e. at least 3 to 1 and is preferably in the range of 4:1 to 8:1 so as to reduce the proportional effect of fluctuations in the pressure of the first air stream.

The number of impellers employed in the second air compressor is selected according to the magnitude of the ratio of its outlet to inlet pressure. The number of sets of guide vanes and/or diffuser vanes that are adjustable may be selected not only in accordance with the need to produce a constant second air compressor outlet pressure but also in accordance with the degree to which it is desired to cater for varying flow rates of air through the second air compressor. Typically, the second air compressor is designed to operate at a maximum air flow rate. The greater the degree of turn down that is required in normal operation, the greater the number of adjustable sets of guide vanes and/or diffuser vanes that are used in it.

Preferably, the flow rate of the purified first air stream and the flow rate of the purified second air stream are adjusted in accordance with variations in the oxygen demand. The ratio of the two flow rates tends, however, to vary only by a small amount. If desired, in order to keep down any need to blow off or vent air from the first air compressor during periods of lower demand for electrical power a part of the first air flow is preferably taken from a position downstream of the first air compressor but upstream of the outlet of the second air compressor and is introduced into the second air stream preferably at an intermediate location in the third air compressor.

Purification of the first air flow upstream of the second air compressor ensures that the purification apparatus does not have to operate at excessive pressures. For example, if an oxygen product is required at 40 bar, the second air stream is heat exchanged with it at a pressure of about 80 bar. Formidable problems are posed in constructing and operating a conventional adsorptive air purification apparatus at such a pressure. Further, difficulties arise in achieving an adequate adsorptive separation of carbon dioxide at such high pressures. Preferably, the first air flow is purified at a pressure in the range of 10 to 20 bar.

Preferably, a single heat exchanger is employed for performing the functions of cooling the first and second flows of air.

Preferably, at least part of the second nitrogen stream is compressed and introduced into the expander of the gas turbine in order to compensate for the air taken from the first air compressor.

The higher pressure rectification column is preferably operated at pressures which are as close as practicable to the outlet pressure of the third air compressor. Allowing for pressure drop through purification apparatus and heat exchange means, it is normally possible to operate the higher pressure rectification column at a pressure at its bottom no more than 1.5 bar less than the outlet pressure of the third compressor. If all the air were taken from the first air compressor, efficient operation of the air separation method would not be possible when faced with variations in the power output of the gas turbine since effective isolation of the high pressure column from these variations could be achieved only at the expense of further compressing the entire air flow into the plant.

Preferably from 20 to 30% of the total air flow for separation is taken from the first air compressor. The ability to operate the plant according to the invention with such a relatively low proportion of the air taken from the first air compressor is a particular advantage as in some gas turbines the amount of air flow able to be bled to the air separation plant is limited. In such examples of the method and plant according to the invention, refrigeration for the air separation method is preferably created by expanding a stream of air taken from the second air flow. It is, however, possible, if the amount of air available from the gas turbine is not so limited, to create refrigeration for the air separation method by expanding a part of the first air flow. This part may be taken from a location downstream of one stage and upstream of the next stage of the second air compressor expanded with the performance of work in a turbine which has adjustable inlet nozzles so as to enable the expansion turbine to provide an air flow at a rate and pressure independent of fluctuations in the output of gas turbine.

Preferably, a stream of oxygen-enriched liquid air is withdrawn from the higher pressure rectification column and separated in an intermediate pressure rectification column operating at a pressure between the pressure at the top of the higher pressure rectification column and that at the bottom of the lower pressure rectification column so as to form both a liquid further enriched in oxygen and an intermediate vapour. A stream of the further-enriched liquid is preferably separated in the lower pressure rectification column. The intermediate vapour is preferably nitrogen, is preferably condensed and a part of the resulting condensate is supplied to the lower pressure rectification column as reflux and another pan is used as reflux in the intermediate pressure column.

Preferably, the oxygen product contains from 80 to 97% by volume of oxygen. Accordingly, the lower pressure rectification column is not required to have an argon-oxygen separation section. If such an impure oxygen product is produced, nitrogen separated in the higher pressure rectification column is preferably condensed by heat exchange with liquid withdrawn from an intermediate mass exchange region of the lower pressure rectification column, and a stream taken from the second flow of air is preferably used to reboil impure oxygen taken from a bottom mass exchange section of the lower pressure rectification column in order to provide reboil for the bottom section of the column.

BRIEF DESCRIPTION OF THE DRAWINGS

The method and plant according to the invention will now be described by way of example with reference to accompanying drawings, in which.

DETAILED DESCRIPTION

Figure 1:
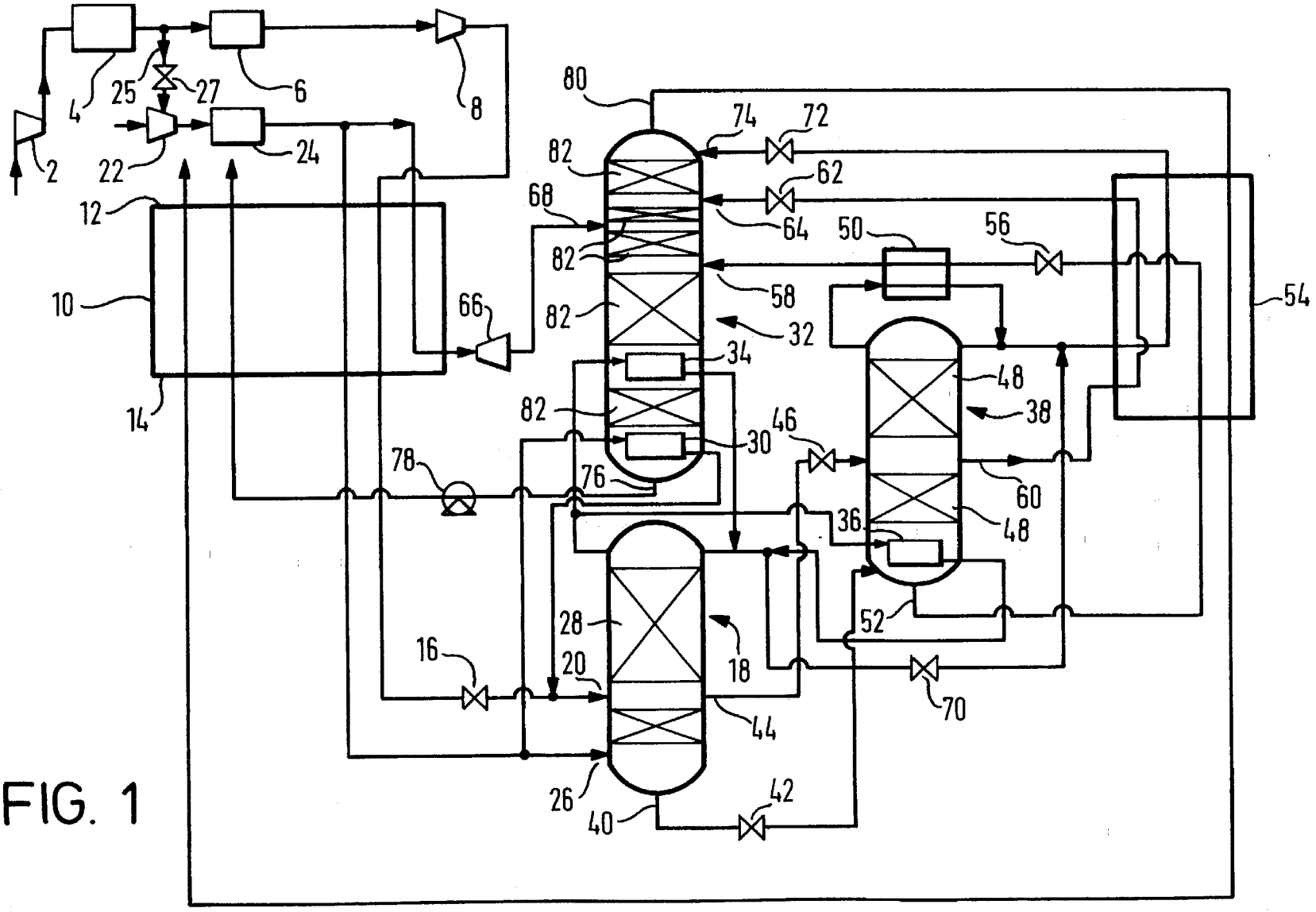
FIG. 1 is a schematic flow diagram, not to scale, of an air separation plant.

Referring to FIG. 1 of the drawings, air is bled at a pressure of about 15 bar from the outlet of an air compressor 2 forming part of a gas turbine (whose other pans are not shown in FIG. 1). The first air compressor is an axial compressor which is operated without interstage cooling or any aftercooling and the air bleed is therefore at elevated temperature. The air bleed is cooled to approximately ambient temperature in an arrangement of heat exchangers indicated generally by the reference numeral 4. Typically, the arrangement of heat exchangers includes one which cools the air by indirect heat exchange with a stream of nitrogen so as to heat the nitrogen stream downstream of compression to a temperature suitable for introduction into the combustion chamber (not shown in FIG. 1) of the gas turbine. The resulting cooled air passes through a purification apparatus or unit 6 effective to remove water vapour and carbon dioxide therefrom. The unit 6 employs beds (not shown) of adsorbent to affect this removal of water vapour and carbon dioxide. The beds are operated out of sequence with one another such that while one or more beds are purifying the feed air stream the remainder are being regenerated, for example by being purged with a stream of hot nitrogen. Typically, activated alumina particles are employed to remove water vapour and, optionally, some carbon dioxide, and the remainder of the carbon dioxide is adsorbed by particles of zeolite 13X adsorbent. Such a purification unit and its operation are well known in the art and are not described further.

The purified first flow of air passes into a second air compressor 8. The second air compressor 8 is an integrally-geared centrifugal compressor. It has an outlet pressure in the order of 80 bar and accordingly employs several stages or impellers (not shown) in order to achieve the necessary compression. Each impeller is located in its own housing (not shown) and on its upstream side has adjustable guide vanes (not shown) and on its downstream side adjustable diffuser vanes (not shown). Further, means (not shown) are provided for cooling the air flow intermediate each pair of adjacent stages and downstream of the final stage. In operation, a decrease in demand for air from the compressor 2 by the gas turbine results in the air compressor 2 being turned down. In consequence, because of the operating characteristics of axial compressors, there is a substantial reduction in the outlet pressure of the air compressor 2. In order to maintain a constant flow of air through the second air compressor 8, the guide vanes and diffuser vanes are adjusted to maintain its outlet pressure essentially constant. Accordingly, the adjustment tends to decrease the impedance to the flow of air provided by the guide vanes and diffuser vanes.

The further compressed air flow (which at 80 bar is above its point of contact (i.e. the critical point at which liquid air can exist in equilibrium with gaseous air) and is hence a supercritical fluid) flows through a main heat exchanger 10 from its warm end 12 to its cold end 14. Downstream of the cold end 14 of the main heat exchanger 10 the first air flow is passed through an expansion device 16 so as to reduce its pressure to essentially that at which a higher pressure rectification column 18 operates. The expansion device 16 is preferably a throttling valve but may alternatively be an expansion turbine. The pressure reduction effected by the device 16 causes the first air flow to liquefy and the resulting flow of liquid air (at a pressure of about 12 bar) is introduced into the higher pressure rectification column 18 through an inlet 20 at an intermediate level thereof.

A second flow of air enters a third air compressor 22 and is compressed therein to, for example, a pressure of about 13 bar. The compressed second flow of air is purified by removal of water vapour and carbon dioxide in a second purification apparatus or unit 24. The unit or apparatus 24 is essentially the same in construction and operation as the unit 6. There is provided a valved by-pass pipeline 25 extending from a position downstream of the heat exchangers 4 but upstream of the purification unit 6 to the inlet of one stage (preferably the most downstream stage) of the third air compressor 22. The pipeline 25 has a pressure reduction valve 27 located in it so as to reduce the pressure of by-passed air to the inlet pressure of the selected stage of the compressor 22 in operation, when the demand for electrical power is at a maximum, the pipeline 25 is kept closed (by means of another valve (not shown) selectively operable to open the pipeline 25).

Downstream of the unit 24, the purified second flow of air is divided into two streams. A first of these streams flows through the main heat exchanger 10 from its warm end 12 to its cold end 14 and is cooled to its saturation temperature or a temperature close thereto. The so-cooled first stream of the second flow of air is divided into two subsidiary streams. One subsidiary stream is introduced into the higher pressure rectification column 18 through an inlet 26 which is located below all liquid-vapour contact devices 28 within the column 18. The second subsidiary stream is condensed by passage through a first reboiler-condenser 30 by heat exchange with impure liquid oxygen separated in a lower pressure rectification column 32. As shown in FIG. 1, the condenser-reboiler 30 is located within the column 32. If desired it can be located outside the column 32. The resulting condensed second subsidiary stream of air is mixed with the first flow of air downstream of the expansion device 16 and is therefore introduced with it into the higher pressure rectification column 18 through the inlet 20.

Nitrogen is separated in the higher pressure rectification column 18 in a manner well known in the art by virtue of intimate contact and hence mass exchange on the devices 28 (which may be distillation trays or packing) between an ascending vapour phase and a descending liquid phase. A stream of nitrogen is withdrawn from the top of the higher pressure rectification column 18 and is condensed by heat exchange in a second reboiler-condenser 34 with liquid withdrawn from an intermediate mass exchange region of the lower pressure rectification column 32. As shown in FIG. 1, the second condenser-reboiler is located within the column 32, but if desired it may be located outside the column 32. Another stream of nitrogen is taken from the top of the higher pressure rectification column 18 and condensed in a third reboiler-condenser 36 by liquid taken from a bottom mass exchange section of an intermediate pressure rectification column 38. Although the third reboiler-condenser 36 is shown in FIG. 1 to be located within the intermediate pressure rectification column 38 it could be located outside the column. The condensates from the reboiler-condensers 34 and 36 are mixed with one another and one part of the mixture is used to provide reflux for the higher pressure rectification column 18.

A stream of oxygen-enriched liquid air which is typically in approximate equilibrium with the vapour introduced through the inlet 26 is withdrawn from the higher pressure rectification column 18 through an outlet 40. This stream flows through a pressure reduction or throttling valve 42 and is introduced into the bottom of the intermediate pressure rectification column 38. A further stream of liquid air is withdrawn from the column 18 through an outlet 44 at the same level as the inlet 20 and is fed to the intermediate pressure rectification column 38 through a pressure reducing or throttling valve 46. Although not shown in FIG. 1, the two liquid streams flowing from the higher pressure column 18 to the intermediate pressure column 38 may both be sub-cooled upstream of their passage through the respective valves 42 and 46.

Nitrogen is separated from the air stream introduced into the intermediate pressure rectification column 38, in a manner well known in the art, by virtue of intimate contact and hence mass transfer between a descending liquid phase and an ascending vapour phase. The contact is effected on liquid-vapour contact devices 48 which may be distillation trays or sections of packing. Downward flow of liquid reflux through the column 38 is created by withdrawing nitrogen from the top of the column 38, condensing it in a condenser 50, and returning a part of the condensate to the top of the column 38.

An oxygen-enriched liquid whose oxygen concentration is greater than that of the liquid withdrawn from the bottom of the higher pressure rectification column 18 through the outlet 40 is passed from the intermediate pressure rectification column 38 through an outlet 52, is sub-cooled by passage through part of a heat exchanger 54, is reduced in pressure by passage through a throttling valve 56, and is at least partially boiled by heat exchange in the condenser 50 with the condensing nitrogen stream therein. The resulting at least partially boiled oxygen-enriched air stream is introduced into the lower pressure rectification column through an inlet 58 at an intermediate level of the column 32. In addition, a liquid air stream is withdrawn from an intermediate mass exchange region of the intermediate pressure rectification column 38 through an outlet 60, is sub-cooled by passage through part of the heat exchanger 54, is reduced in pressure by passage through a throttling valve 62, and is introduced into the lower pressure rectification column 32 through an inlet 64 which is located above the inlet 58. A further stream of air for separation in the lower pressure rectification column 32 is constituted by the aforesaid second stream of the purified air flow from the purification apparatus 24. This air stream is cooled to a temperature in the order of 150 K. by passage through the main heat exchanger 10 from its warm end 12 to an intermediate region thereof. The thus cooled air stream is expanded in an expansion turbine 66 with the performance of external work, and is introduced into the lower pressure rectification column 32 through an inlet 68 which is situated above the inlet 58 but below the inlet 64.

The air introduced into the lower pressure rectification column 32 is separated, in a manner well known in the art, into nitrogen and impure oxygen. The separation takes place by virtue of intimate contact and hence mass exchange between ascending flow of vapour and descending flow of liquid. The necessary liquid nitrogen reflux for operation of the lower pressure rectification column 32 is provided by taking some of the liquid nitrogen that is condensed in the reboiler-condensers 34 and 36 and the condenser 50. Thus, a part of the combined flow of liquid nitrogen condensate from the reboiler-condensers 34 and 36 is passed through a throttling valve 70 so as to reduce its pressure and is merged with a part of the condensate that is formed in the condenser 50. If desired, the combined flow may be sub-cooled upstream of the throttling valve 70. The resulting combined stream of liquid nitrogen is sub-cooled by passage through a part of the heat exchanger 54, is further reduced in pressure by passage through a throttling valve 72 and is introduced into the top of the lower pressure rectification column 32 through an inlet 74.

A flow of liquid downwardly through the column 32 comes into intimate contact with an ascending vapour created by operation of the reboiler-condensers 30 and 34. The intimate contact takes place on suitable liquid-vapour contact devices 82 such as distillation trays or packing (for example, structured packing).

An impure liquid oxygen product is withdrawn from the bottom of the lower pressure rectification column 32 through an outlet 76 by means of a pump 78 which raises the liquid to an elevated pressure, for example, 40 bar. The resulting pressurised liquid (or supercritical fluid if the pump raises the pressure above the critical pressure of liquid oxygen) flows through the main heat exchanger 10 from its cold end 14 to its warm end 12 and leaves the heat exchanger 10 at approximately ambient temperature as respectively a gas or a supercritical fluid. The oxygen may be supplied without further compression to a coal gasifier (not shown in FIG. 1 ) in which a fuel gas for combustion in the gas turbine is generated.

A nitrogen stream is withdrawn from the top of the lower pressure rectification column 32 through an outlet 80 and is warmed by passage in sequence through the heat exchanger 54 and the main heat exchanger 10 from its cold end 14 to its warm end 12. The nitrogen leaves the heat exchanger 10 at approximately ambient temperature. A part of the nitrogen may be further compressed and employed in the expander (not shown in FIG. 1) of the gas turbine to compensate for the air bled from the air compressor 2. In addition, the same or another part of the nitrogen may be used in regenerating the purification units 6 and 24.

In a typical example of the operation of the air separation plant shown in FIG. 1, the higher pressure column may operate with a pressure of about 12 bar at its top, the intermediate pressure rectification column 38 with a pressure of about 8 bar at its top, and the lower pressure rectification column 32 with a pressure of about 4.5 bar at its top. The use of the intermediate pressure rectification column 38 enables a relatively small ratio to be maintained between the operating pressures of the higher and lower pressure columns. Accordingly, for a given operating pressure of the higher pressure column 18 the pressure at which the nitrogen product is produced in the lower pressure rectification column 32 is higher than in a conventional double column and as a result less work of nitrogen compression needs to be performed downstream of the warm end of the main heat exchanger 10 so as to raise the pressure of the nitrogen to the operating pressure of the gas turbine (which is normally in the order of 15 bar).

In operation, a reduction in the rate at which oxygen is taken from the plant shown in FIG. 1 is responded to by reducing the rate at which air is taken for separation. Accordingly, a decrease in the rate at which oxygen product is taken leads to a decrease in the rate at which the first air flow is supplied to the heat exchanger 10. The flow rate of air out of the purification unit 24 so as to ensure that oxygen is produced at the desired rate. Typically, the ratio of purified first air flow rate to purified second air flow strays approximately constant irrespective of changes in the oxygen product flow rate. The reduction in the second air flow rate may be effected by appropriate turn down of the third air compressor 22. In order to avoid surge conditions being created in the first air compressor 2, the by-pass pipeline 25 may be opened and some of the air from the cooled first flow of air by-passed from upstream of the purification unit 6 to the air compressor 22, as previously described. The rate at which such by-pass air can be taken is limited and, accordingly, the outlet of the air compressor 2 is typically provided with a valved vent line (typically downstream of the heat exchanger 4) to allow any excess air to be vented to the atmosphere.

Figure 2:
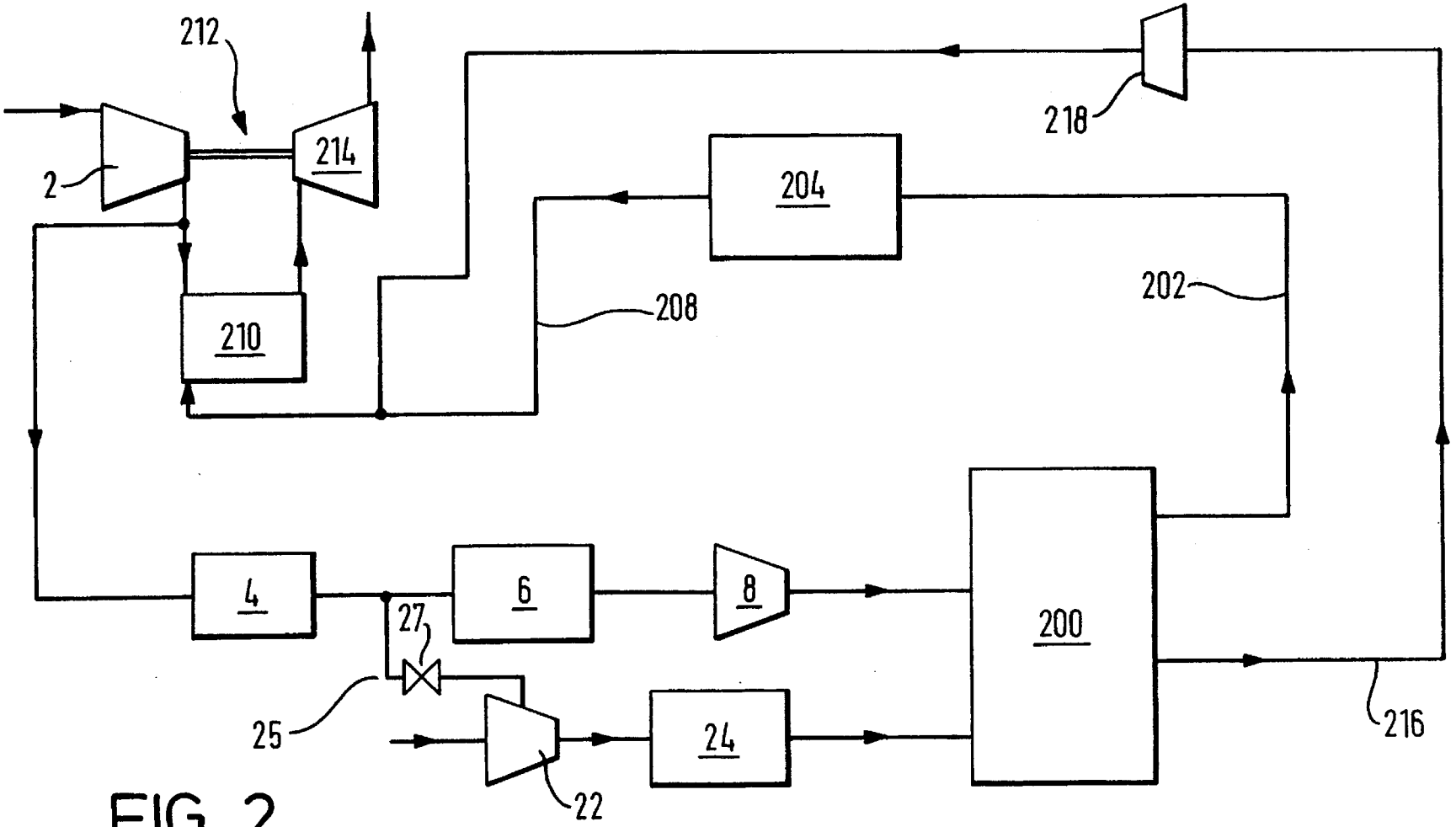
FIG. 2 is a schematic flow diagram illustrating integration of the air separation plant with a coal gasifier and a gas turbine.

Referring now to FIG. 2, the air separation plant (excluding its compressors) is generally indicated by reference 200. The air compressor and purification units and associated parts are indicated by the same reference numerals in FIG. 1. The oxygen product is supplied via a conduit 202 from the air separation plant 200 to a coal gasification plant 204. No compression of the oxygen takes place intermediate the air separation plant 200 and the coal gasification plant 204. A fuel gas is supplied via a conduit 208 to the combustion chamber 210 of a gas turbine 212 of which the air compressor 2 forms a part. Equipment for cooling, purifying and adjusting the pressure of the fuel gas stream are omitted from FIG. 2 but are well known in the art. The combustion chamber 210 also has an inlet for the main part of the air compressed in the compressor 2. Combustion of the fuel gas takes place in the combustion chamber 210 and the resulting fuel gases are expanded in the expander 214 of the turbine 212. Typically, the gases that exhaust from the expander 214 are used to raise steam and the resulting steam is expanded in a steam turbine (not shown). The expander 214 and the steam turbine are typically coupled to alternators (not shown) forming part of electrical power generation plant (not shown).

Turning down the flow rate of air into the plant 200 not only reduces the rate at which oxygen is produced but also that at which nitrogen is produced and typically, there will be a corresponding reduction in the rate of supply of nitrogen to the turbine 212.

A stream of nitrogen is taken from the air separation plant via conduit 216 and is compressed to the operating pressure of the gas turbine 212 in a compressor 218. The resulting compressed nitrogen is introduced into the compression chamber 210.

The plant shown in FIG. 2 is arranged for operation at a chosen power output from the gas turbine 212 which is intended to meet a peak daytime demand for electrical power. Normally, at night time, the demand for electrical power falls, and hence the gas turbine 212 is required to produce less power. Accordingly, fuel gas is demanded from the plant 204 at a lower rate, air is required by both the gas turbine and the air separation plant 200 at a lower rate, and there is also a reduction in the requirement for nitrogen and oxygen to be supplied from the air separation plant 200 to the gas turbine 212 and the gasification plant 204 respectively. As previously described, these requirements can be met by turn down of the three air compressors 2, 8 and 22. If necessary, a part of the first flow of air can be passed along the pipeline 25 to the compressor 22 in the event that the compressor 2 at its minimum operational flow rate provides an excess of air over that which is demanded from the compressor 8 by the control system of the air separation plant. If the limit to which the compressor 22 can accept such by-passed air is reached, any additional flow of air is vented from the plant.

We claim:

1. In a method of separating air comprising:

a) taking a first flow of air from a first air compressor associated with a gas turbine;

b) purifying said first flow of air by separating water vapour and carbon dioxide therefrom;

c) further compressing at least part of the first air flow in a second air compressor;

d) heat exchanging at least part of the further compressed and purified first air flow with a stream of pressurised oxygen taken from a lower pressure rectification column in liquid state;

e) reducing the pressure of at least part of the heat exchanged first air flow and introducing it into a higher pressure rectification column;

f) compressing a second flow of air in a third air compressor which is independent of said gas turbine;

g) purifying said second flow of air by separating water vapour and carbon dioxide therefrom, cooling the second flow of air, and introducing the cooled second flow of air into the higher pressure rectification column;

h) rectifying the air flows in the higher and lower pressure rectification columns; and i) withdrawing a gaseous nitrogen stream from the lower pressure rectification column;

the improvement comprising:

i) operating the second air compressor with an outlet pressure independent of fluctuations in the power output of the gas turbine;

ii) purifying of the first air flow at a pressure at least about 5 bar less than that at which the said part of the first air flow leaves the second compressor;

iii) operating the lower pressure rectification column at pressures in excess of about 2 bar;

iv) pressurising the liquid oxygen to a pressure of at least about 25 bar.

2. The method as claimed in claim 1, wherein the second air compressor is an integrally geared centrifugal compressor.

3. The method as claimed in claim 1, wherein the second air compressor is operated with a ratio of its outlet pressure to its inlet pressure of at least 3:1.

4. The method as claimed in claim 1, in which the absolute values of the purified air flow rates are varied in accordance with the demand for oxygen product.

5. The method as claimed claim 1, in which a part of the first air flow is taken from a position downstream of the first air compressor but upstream of the second air compressor and is introduced into the second air flow.

6. The method as claimed in claim 5, in which the part of the first air stream that is introduced into the second air flow enters the second air flow at an intermediate location in the third air compressor.

7. The method as claimed in claim 1, in which at least part of said nitrogen is supplied to an expander forming part of the gas turbine.

8. The method as claimed claim 1, in which from about 20 to about 30% of the total air flow for separation is taken from the first air compressor.

9. The method as claimed in claim 8, in which refrigeration for the air separation method is created by expanding a stream of air taken from the second air flow.

10. The method as claimed in claim 1, in which refrigeration for the air separation method is created by expanding a stream of air taken from the first air flow.

11. The method as claimed in claim 1, in which purification of the first air flow, or at least part thereof, is performed at a pressure in the range of about 10 to about 20 bar.

12. The method as claimed in claim 1, in which the stream of oxygen-enriched liquid air is withdrawn from the higher pressure rectification column and separated in an intermediate pressure rectification column operating at a pressure between the pressure at the top of the higher pressure rectification and that at the bottom of the lower pressure rectification column so as to form both a liquid further enriched in oxygen and an intermediate vapour, and separating a stream of the further-enriched liquid in the lower pressure rectification column.

13. The method as claimed in claim 12, in which the intermediate vapour is nitrogen and the intermediate vapour is condensed and a part of the resulting condensate is supplied to the lower pressure rectification as reflux and another part is used as reflux in the intermediate pressure column.

14. A plant for separating air comprising:

a first air compressor associated with a gas turbine;

first means for purifying said first flow of air by separating water vapour and carbon dioxide therefrom;

a second air compressor for further compressing at least part of said purified air flow;

a heat exchanger for reducing the temperature of the first air flow countercurrent heat exchange with a stream of pressurised oxygen;

an arrangement of a higher pressure rectification column and a lower pressure rectification column, the higher pressure column having an inlet for at least part of the cooled first air flow;

a third air compressor for compressing a second flow of air which is independent of said gas turbine;

second means for purifying said second flow of air by separating water vapour and carbon dioxide therefrom;

a heat exchanger for cooling the purified second flow of air having an outlet for cooled air in communication with the higher pressure rectification column; and a pump for withdrawing said stream of pressurised oxygen from the lower pressure rectification column; and an outlet from the lower pressure rectification column for a gaseous nitrogen stream;

the second air compressor having means for adjusting operation so as to set its outlet pressure independently of fluctuations in the power output of the gas turbine;

the first means for purifying the first flow of air is one of positioned upstream of the second air compressor and has an inlet in communication with an outlet of one stage of the second air compressor and an outlet in communication with an inlet of another stage of the second air compressor;

the lower pressure rectification column is operable at pressures in excess of about 2 bar; and said pump is configured to raise the pressure of the oxygen to at least about 25 bar.

15. The plant as claimed in claim 14, wherein the second air compressor is an integrally geared centrifugal compressor.

16. The plant as claimed in claim 15, in which the said centrifugal compressor has a plurality of impellers, each impeller having its own housing, a set of guide vanes associated with its upstream side and a set of diffuser vanes associated with its downstream side.

17. The plant as claimed in claim 16, in which some or all the sets of guide vanes and diffuser vanes are adjustable whereby the second air compressor is able to supply air at a substantially constant pressure in the normal range of fluctuations of gas turbine power output.

18. The plant as claimed claim 14, additionally including means for selectively placing the outlet of the first air compressor in communication with the second air flow.

19. The plant as claimed in claim 18, wherein said selective means places said first air compressor outlet in communication with an inlet to a stage of the third air compressor.

20. The plant as claimed in claim 14, in which a single heat exchanger is employed for performing the functions of cooling the first and second flows of air.

* * * * *